US008072123B1

(12) United States Patent
Han

(10) Patent No.: US 8,072,123 B1
(45) Date of Patent: Dec. 6, 2011

(54) ILLUMINATION APPARATUS

(76) Inventor: Tae-kyu Han, Inchon (KR)

( * ) Notice: Subject to any disclaimer, the term of this patent is extended or adjusted under 35 U.S.C. 154(b) by 0 days.

(21) Appl. No.: 13/044,312

(22) Filed: Mar. 9, 2011

(30) Foreign Application Priority Data

Jun. 7, 2010 (KR) ..... 10-2010-0053334

(51) Int. Cl.
*H01J 1/02* (2006.01)

(52) U.S. Cl. ..... 313/45; 313/498; 362/294; 362/249.03

(58) Field of Classification Search ..... 313/19, 313/27, 33, 34, 39–41, 44–46, 498, 500, 313/147, 148, 356, 357; 362/218, 294, 555, 362/800, 581, 223, 224, 238–240, 414, 419, 362/427

See application file for complete search history.

(56) References Cited

U.S. PATENT DOCUMENTS

| | | | | |
|---|---|---|---|---|
| 4,430,638 | A * | 2/1984 | Parker | 340/473 |
| 5,072,341 | A * | 12/1991 | Huang | 362/96 |
| 7,131,753 | B1 * | 11/2006 | Edwards, Jr. | 362/405 |
| 2005/0018435 | A1 * | 1/2005 | Selkee et al. | 362/427 |
| 2007/0070628 | A1 * | 3/2007 | Chen | 362/249 |
| 2011/0051437 | A1 * | 3/2011 | Ng et al. | 362/427 |

FOREIGN PATENT DOCUMENTS

| | | | |
|---|---|---|---|
| KR | 10-2009-0054678 | A | 6/2009 |
| KR | 10-2009-0080015 | A | 7/2009 |
| KR | 10-0987735 | B1 | 10/2010 |

* cited by examiner

*Primary Examiner* — Peter Macchiarolo
(74) *Attorney, Agent, or Firm* — Echelon Law Group, PC

(57) ABSTRACT

Various exemplary embodiments of an illumination apparatus are disclosed. One exemplary embodiment of the illumination apparatus may include: a socket; a cylindrical body having one end connected to the socket, the cylindrical body comprising an inner space for receiving a driving circuit and a wire; a cap connected to the other end of the cylindrical body, the cap comprising a plurality of engaging members disposed around a circumference of the cap with an equal interval; a hinge portion comprising a plurality of hinges for rotationally connecting the plurality of engaging members; a light source portion comprising a plurality of light modules, each of the plurality of light modules comprising a plurality of light emitting devices arranged therein, each of the plurality of light modules being configured to rotate with the hinge portion in a first direction with respect to a respective one of the plurality of engaging members via the hinge; and a heat dissipater having a plurality of heat dissipation plates, each of the het dissipation plates being in contact with a bottom portion of the respective light module.

18 Claims, 7 Drawing Sheets

ILLUMINATION APPARATUS

CROSS-REFERENCE TO RELATED APPLICATION(S)

This application claims the benefit under 35 U.S.C. §119 (a) of Korean Patent Application No. 10-2010-0053334, filed on Jun. 7, 2010, in the Korean Intellectual Property Office, the entire disclosure of which is incorporated herein by reference.

BACKGROUND

1. Field

Various embodiments of the present disclosure relate to an illumination apparatus. In particular, certain embodiments relate to an illumination apparatus that uses a light emitting diode (LED), an organic light emitting diode (OLED), or the like as a light source.

2. Description of Related Art

Incandescent or fluorescent lights are commonly used for indoor or outdoor illumination. For street lights, sodium lamps or other metal lamps are arranged along the sides of a roadway with an interval of about 30 to 50 meters. Incandescent lights used as light sources for illumination purposes emit light by heating filaments, but have low efficiency. Fluorescent lights, on the other hand, emit light by illuminating fluorescent substances. While the fluorescent lights have an advantage of low power consumption over the incandescent lights, the fluorescent lights use mercury (Hg) as the fluorescent substances which is harmful to human body. Also, sodium lamps or other metal lamps have drawbacks of high power consumption and short lifespan.

Recently, illumination devices adopting LEDs or OLEDs as light sources have been developed. LED or OLED show excellent performance as lighting materials because they have longer lifespan and low power consumption. Specifically, LED or OLED lamps have a lifespan greater than three times of typical fluorescent lights with comparable brightness thereof.

The LED or OLED lamps, however, have limited usage for illumination due to their narrow viewing angles and heating problems. Therefore, there is a need to develop an LED or OLED lamps that obviate these problems.

Korean Patent Publication No. 2009-0041480, entitled "Lamp-Type LED Illumination Apparatus with Scattering Structure," discloses an illumination apparatus that deals with the above-mentioned problems. The illumination apparatus disclosed in this publication includes a socket portion having a screw thread on its surface; an outer tubular body connected to the socket portion; a power source disposed inside the outer tubular body and electrically connected to the socket portion, the power source supplying power through power conversion, controlling the power supply, and managing heat dissipation; an outer scattering lens portion connected to the outer tubular body and scattering light; a heat pipe disposed inside the outer scattering lens portion to dissipate heat; and an LED device connected to the heat pipe through an electrical connection with the power source and emitting light by supplying and controlling power from the power supply. The illumination apparatus further includes a heat dissipater that dissipates the heat generated in heat pipes by the LED device.

The LED device includes a plurality of light modules which consist of light-emitting LEDs; a plurality of circuit boards each of which is connected to the respective one of the light modules; and a plurality of inner scattering lenses, each of which is connected to the respective one of the light modules to primarily scatter the light emitted from the LED modules.

In the above apparatus, a heat dissipater portion includes a heat dissipation plate having a plurality of pins that increase a heat dissipation contact area; and a heat dissipation fan being in contact with the heat dissipation plate and blowing wind in a direction perpendicular to its rotational direction, to externally discharge the heat generated from the plurality of light modules.

Further, the outer scattering lens portion is composed of a plurality of concave lenses having a hexagonal cross-sectional shape and being connected adjacent to each other. The outer scattering lens portion thus configured scatters, for the second time, the light that has been primarily scattered by the inner scattering lens portion. The scattered angle of the light emitted from the light modules is then increased, thereby enhancing light uniformity.

The illumination apparatus described above, however, has a problem of reduced heat dissipation efficiency due to the fact that the heat generated by the light modules is dissipated through the elongated heat pipes disposed inside the outer tubular body and that the multiple heat pipes are disposed in close proximity to one another. Furthermore, since the light modules are fixed and thus the degree of scattering of the emitted light is constant, it may be difficult to control the light uniformity in certain circumstances.

SUMMARY

Accordingly, there is a need for an improved illumination apparatus that may obviate one or more problems discussed above. Thus, various exemplary embodiments of the present disclosure may provide an illumination apparatus capable of increasing the efficiency of heat dissipation for heat generated in the light modules. Further, certain exemplary embodiments may provide an illumination apparatus capable of adjusting light uniformity by varying an illumination angle of light generated from each of the plurality of light modules. According to some exemplary embodiments, the present disclosure may provide a multi-purpose illumination apparatus that can also be used in conjunction with other products such as ornamental and/or indirect illumination devices. Moreover, certain exemplary embodiments may provide an illumination apparatus that permits replacement of only the malfunctioning light modules among a plurality of light modules, thereby reducing the maintenance cost.

To attain the advantages and in accordance with the purposes of the invention, as embodied and broadly described herein, one exemplary aspect may provide an illumination apparatus, which may comprise: a socket; a cylindrical body having one end connected to the socket, the cylindrical body comprising an inner space for receiving a driving circuit and a wire; a cap connected to the other end of the cylindrical body, the cap comprising a plurality of engaging members disposed around a circumference of the cap with an equal interval; a hinge portion comprising a plurality of hinges for rotationally connecting the plurality of engaging members; a light source portion comprising a plurality of light modules, each of the plurality of light modules comprising a plurality of light emitting devices arranged therein, each of the plurality of light modules being configured to rotate with the hinge portion in a first direction with respect to a respective one of the plurality of engaging members via the hinge; and a heat dissipater having a plurality of heat dissipation plates, each of the het dissipation plates being in contact with a bottom portion of the respective light module.

In another aspect of the invention, the illumination apparatus may further comprise an elongated receiving groove formed along a lengthwise direction on a surface of a middle portion of the body, the receiving grooving comprising a semi-circular shape.

In another aspect of the invention, the illumination apparatus may further comprise an intake passageway located at a portion of the body that connects to the cap, the intake passageway being configured to spatially connect the receiving groove to the outside of the body; and an exhaust passageway at a portion of the body that connects to the socket, the exhaust passageway being configured to spatially connect the receiving groove to the outside of the body.

In another aspect of the invention, wherein the plurality of engaging members may comprise first through-holes on side surfaces that face one another and a first protrusion formed on one of the side surfaces near the first through-hole.

In another aspect of the invention, each of the hinges may further comprise: a first part comprising a semi-circular plate member having a second through-hole formed at a center location corresponding to the first through-hole, the plate member further comprising a plurality of first depressions configured to receive the first protrusion, the plurality of first depressions being radially disposed with an equal interval around a peripheral region of a surface that contacts the engaging member; and a second part comprising a diameter forming a perpendicular angle with respect to the first part, the second part comprising an axial shaft disposed at a center of a bottom surface thereof and a plurality of second depressions disposed radially around a peripheral region with an equal interval.

In another aspect of the invention, the first part of the hinge and the engaging member may be engaged through a bolt and a nut that pass through the first and second through-holes.

In another aspect of the invention, the illumination apparatus may further comprise a spring having a spring force inserted in the first through hole while wrapping a body of the bolt between a head of the bolt and the first part.

In another aspect of the invention, the second part of the hinge may engage the axial shaft with a nut when the axial shaft passes through a third through-hole formed at a center of a first coupler.

In another aspect of the invention, the illumination apparatus may further comprise a second spring positioned between the first coupler and the nut.

In another aspect of the invention, the plurality of light emitting devices may comprise LEDs or OLEDs.

In another aspect of the invention, the plurality of light emitting devices may be selected from a group of red (R), green (G), blue (B), and white (W) light emitting devices.

In another aspect of the invention, the plurality of light emitting devices may comprise red (R), green (G), blue (B), or white (W) light emitting devices mounted on a single printed circuit board.

In another aspect of the invention, the plurality of light emitting devices may be sealed by lenses formed of transparent or translucent synthetic resin in a hemispheric shape.

In another aspect of the invention, the lenses may have their radii of curvature decreasing from a first end of the light module that connects to the hinge to a second end opposite to the first end.

In another aspect of the invention, the plurality of light modules may further comprise semi-cylindrical covers for sealing the light modules.

In another aspect of the invention, the plurality of light modules may further comprise semi-cylindrical cover for sealing the light modules, each of the covers comprising a plurality of protruding lenses at a location where the corresponding light emitting devices are located.

In another aspect of the invention, each of the light modules may be configured to axially rotate in a second direction with respect to the hinge portion.

In another aspect of the invention, the light module is configured to rotate 180 degrees in the first direction while one end of the light module is connected to the hinge and rotate 360 degrees in a second direction with respect to a longitudinal direction of the light module.

Other features and aspects may be apparent from the following detailed description with the drawings, and the accompanying claims.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate various embodiments consistent with the invention and, together with the description, serve to explain the principles of the invention.

Figure 1:
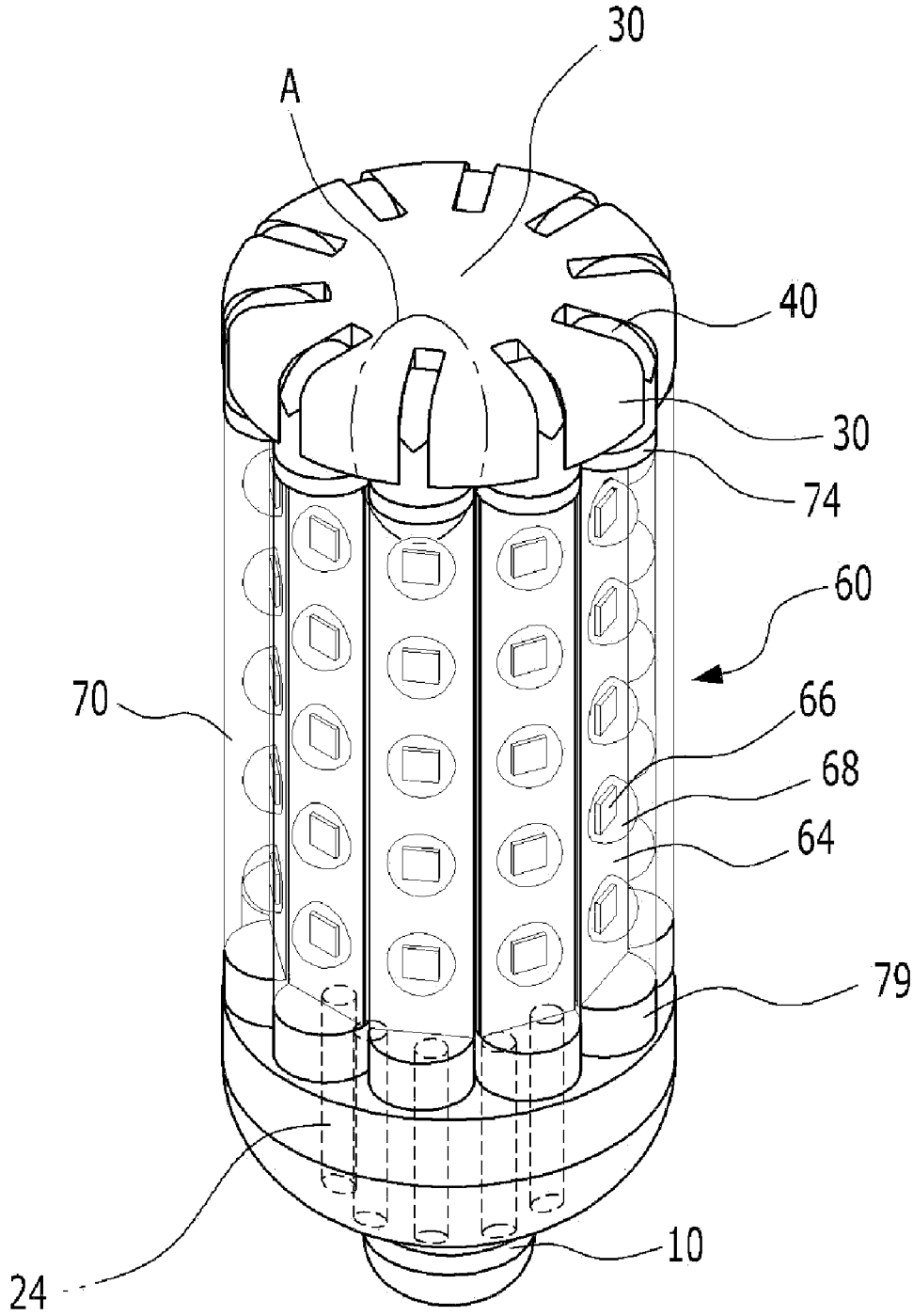
FIG. 1 is a perspective view of an illumination apparatus according to one exemplary embodiment of the present disclosure.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses and/or systems described herein. Various changes, modifications, and equivalents of the systems, apparatuses, and/or methods described herein will suggest themselves to those of ordinary skill in the art. Descriptions of well-known functions and structures are omitted to enhance clarity and conciseness.

Referring to FIGS. 1-4, an illumination apparatus, according to one exemplary embodiment consistent with the present disclosure, may comprise a socket 10, a body 20, a cap 30, a hinge portion, and a light source portion 60.

The socket 10 may comprise a screw thread on its surface so that it could be connected to a receiving socket (not shown) of a typical illumination lamp.

The body 20 may have a generally cylindrical shape, and one end of the body 20 is attached to the socket 10. The body 20 may have an inner space in which one or more driving circuits (not shown) and wires (not shown) may be disposed.

Figure 2:
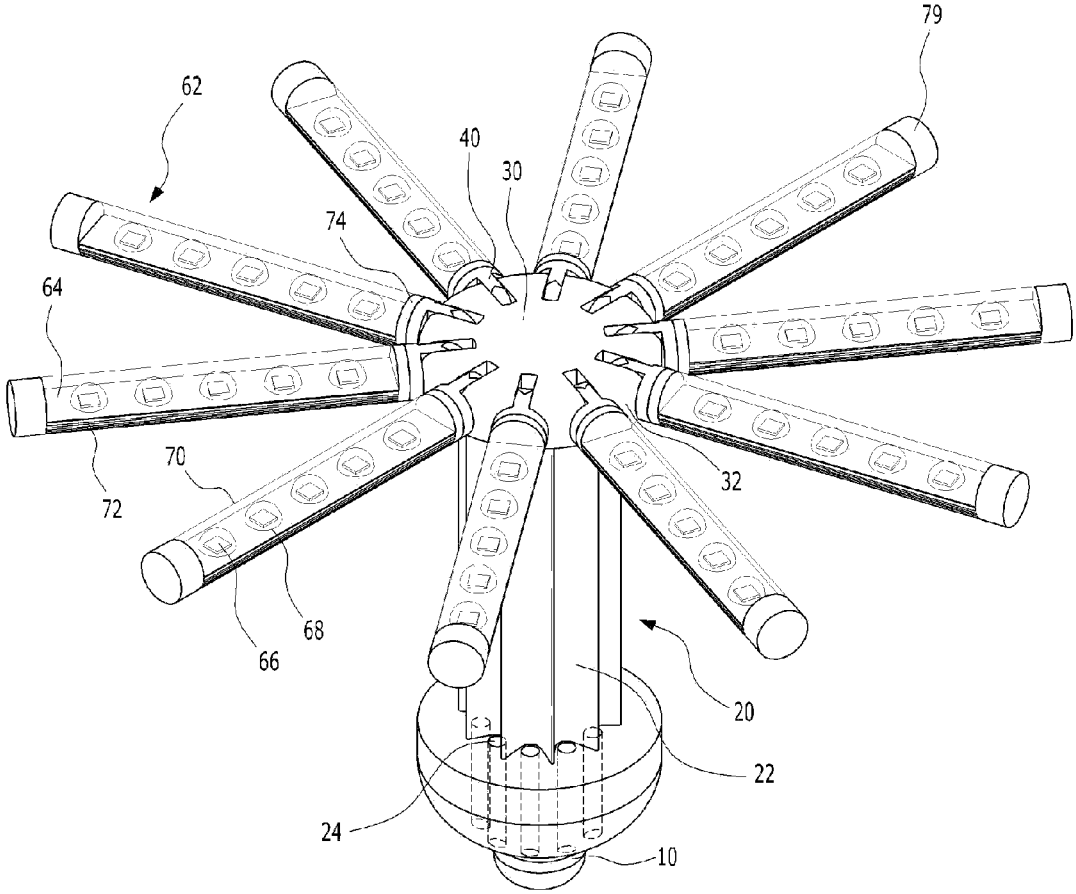
FIG. 2 is a perspective view of the illumination apparatus of FIG. 1, with a plurality of light sources being in an open position.

The driving circuit disposed in the inner space of the body 20 may be powered through the socket 10 and provide power source to the light source 60 and control operations of the light source 60. The body 20 has one end connected to the socket 10, and the portion of the body 20 that connects to the socket 10 may have a portion protruding radially with a diameter greater than that of the middle portion of the body 20. The middle portion of the body 20 may have receiving grooves 22 formed along the lengthwise-direction of the body 20. In some exemplary embodiments, as best shown in FIG. 2, the receiving grooves 22 may have a semicircular cross-section.

Each of the receiving grooves 22 may receive a respective light module 62 that comprises the light source portion 60, which will be described later. Each of the light modules 62 is connected to a hinge 40, and can rotate to be lodged at and/or dislodged from the receiving groove 22. The surface of the receiving groove 22 near the opening edges contacts the rear surface of a received light module 62 while the deeper surface of the groove 22 does not contact the rear surface of the light module 62 so as to form a space therebetween. At the end to which the socket 10 is attached, the body 20 may form exhaust passageways 24 that spatially connect the receiving grooves 22 to the outside environment so as to exhaust the emitted heat outside of the body 20.

The cap 30 is connected to the other end of the body 20, and has a larger diameter than the middle of the body 20 to make protrusion. The cap 30 has a plurality of engaging members 32 spaced apart with equal intervals around its circumference. Each of the plurality of engaging members 32 may have a first through-hole 34 at a corresponding location to the adjacent engaging members 32. The cap 30 may also have intake passageways (not shown) spatially connecting the receiving grooves 22 to the outside, which intakes external air. The intake passageways (not shown) intakes cool external air while the heated air in the receiving grooves 22 is externally exhausted through the exhaust passageways 24.

The light source portion 60 comprises a plurality of light modules 62. One end of each of the plurality of light modules 62 is rotationally engaged to one of the plurality of engaging members 31 by way of one of the hinges 40 constituting a hinge portion. Each of the plurality of light modules 62 has a plurality of light emitting devices 66 on a printed circuit board 64 which is formed with a narrow width in a longitudinal direction. By way of example only, the number of light emitting devices 66 may be 1 to 24 and arranged in one or two rows. The plurality of light emitting devices 66 may be LEDs or OLEDs. Since the light source portion 60 may comprise a number of light modules 62, only the malfunctioning light modules can be replaced at the time of repair, thereby reducing the maintenance cost.

Any one type among red (R), green (G), blue (B) and white (W) light emitting devices may be selected for the plurality of light emitting devices 66. Also, various combination of any types of red (R), green (G), blue (B) and white (W) light emitting devices may be mounted on a single printed circuit board 64.

One end of each of the plurality of light modules 62 is attached to one of the plurality of hinges 40, and the other end thereof may rotate 180 degrees at a first direction with respect to the engaging member 32 of the cap 30 following a circular arc. The maximum rotational angle of the light modules 62 with respect to the respective engaging member 32 may be greater or less than 180 degrees. Also, each of the plurality of light modules 62 may rotates 360 degrees in a second direction with respect to the longitudinal axis of the light module 62. Each of the hinges 40, which connects the light module 62 to the cap 30, is configured to permit rotation of the light modules with respect to the cap 30. In some exemplary embodiments, the light module 62 may not rotate freely and have limited maximum rotational angle. The illumination angle of the light generated by the light source portion 60 may be changed by rotating the plurality of light modules 62 in the first and second directions, which may enhance light uniformity.

For example, as shown in FIG. 2, the distal end of each of the plurality of light modules 60 may be rotated 90 degrees in the first direction with respect to the engaging member 32 following the circular arc so as to increase the brightness underneath the light source portion 60. Alternatively or additionally, the distal end of each of the plurality of light modules 62 may be rotated 90 degrees in the first direction and then axially rotated 180 degrees in the second direction so as to direct the light emitted from the light modules 62 towards a ceiling or side wall to obtain indirect illumination.

Depending on its intended use, the light modules 62 may be adjusted to alter the illumination angle and/or to direct the emitted light towards a ceiling, a wall, or an object for indirect illumination. Also, because various light emitting devices (e.g., various colors) may be selectively used, the illumination apparatus may be used not only for illumination purposes but also for decorative purposes and can be used with various ornamental and indirect illumination lights.

Each of the light emitting devices 66 is sealed or encapsulated by a lens 68. The lens 68 is used to scatter the light emitted from the light emitting device 66 and may be formed of a transparent synthetic resin material. In some exemplary embodiments, the lens 68 may have substantially a hemispherical shape. Also, the lens 68 may be formed of a translucent synthetic resin material to prevent eye strain causes by over-brightness of the light emitting devices 66.

The hemispherical lenses 68 in a light module 62 may have different radii of curvatures from one another. For example, according to one exemplary embodiment, the lenses 68 may have their radii of curvature decreasing from the one end of the light module 62 to the other end thereof. The illumination apparatus thus structured may have increased light uniformity at the border region with an adjacent illumination apparatus (e.g., a border region between two street lights).

In some exemplary embodiments, each of the plurality of light modules 62 may be sealed or encapsulated by a cover 70. The cover 70 may be formed of a transparent material and have substantially a semi-cylindrical shape.

While it has been described that each of the light modules 62 may include hemispherical lenses 68 encapsulating the light emitting devices 66 and the cover 70, the lenses 68 and the cover 70 may be integrally formed. The cover 70 on each of the light modules 62 may be have a plurality of protruding lenses on its outer surface at locations where the corresponding light emitting devices 66 are located.

As shown in, for example, FIG. 2, the heat dissipater comprises a plurality of heat dissipation plates 72. Each of the heat dissipation plates 72 is made of copper, aluminum, magnesium, ceramic, or alloy thereof and dissipates the heat generated from the operation of the light emitting devices 66. Each of the plurality of heat dissipation plates 72 is a part of the light module 62 and contacts with the bottom of the printed circuit board 64 on which the light emitting device 66 is mounted, so as to efficiently dissipate the heat generated by the light emitting device 66 to the respective receiving groove 22 or outside.

When the plurality of light modules 62 are accommodated in the receiving grooves 22 as shown in FIG. 1, the emitted heat is dissipated to the bottom of the receiving grooves 22 through the heat dissipation plates 72, and then externally exhausted through the exhaust passageways 24. At this time, cooler surrounding air enters into the receiving grooves 22 through the intake passageways (not shown).

Each of the plurality of light modules 62 is attached to the respective light dissipation plate 72, which contacts the light module 62 at its both ends by the first and second couplers 74 and 79. Each of the first couplers 74 couples the light module 62 with the respective heat dissipation plate 72 and is rotatably attached to the respective hinge 40 and capably of rotating 360 degrees in the second direction with respect to the longitudinal axis of the light module 62. With this structure, each of the plurality of light modules 62 can rotate 360 degrees with respect to the respective engaging member 32 of the cap 30 and the hinge 40.

Each of the plurality of heat dissipation plates 72 may rotate, together with the respective light module 62 attached thereto with the first and second couplers 74 and 79, 180 degrees in the first direction, following a circular arc, and/or rotate 360 degrees in the second direction with respect to the longitudinal axis of the light module 62. Thus, the plurality of heat dissipation plates 72 can be dislodged from the respective receiving grooves 22, which are formed longitudinally along the body 20 with a semi-circular cross-section, and be exposed without contacting the body 20, thereby facilitating the dissipation of heat generated by the light emitting devices 66 to outside without any heat accumulation therein and enhancing the heat dissipation efficiency.

Figure 5:
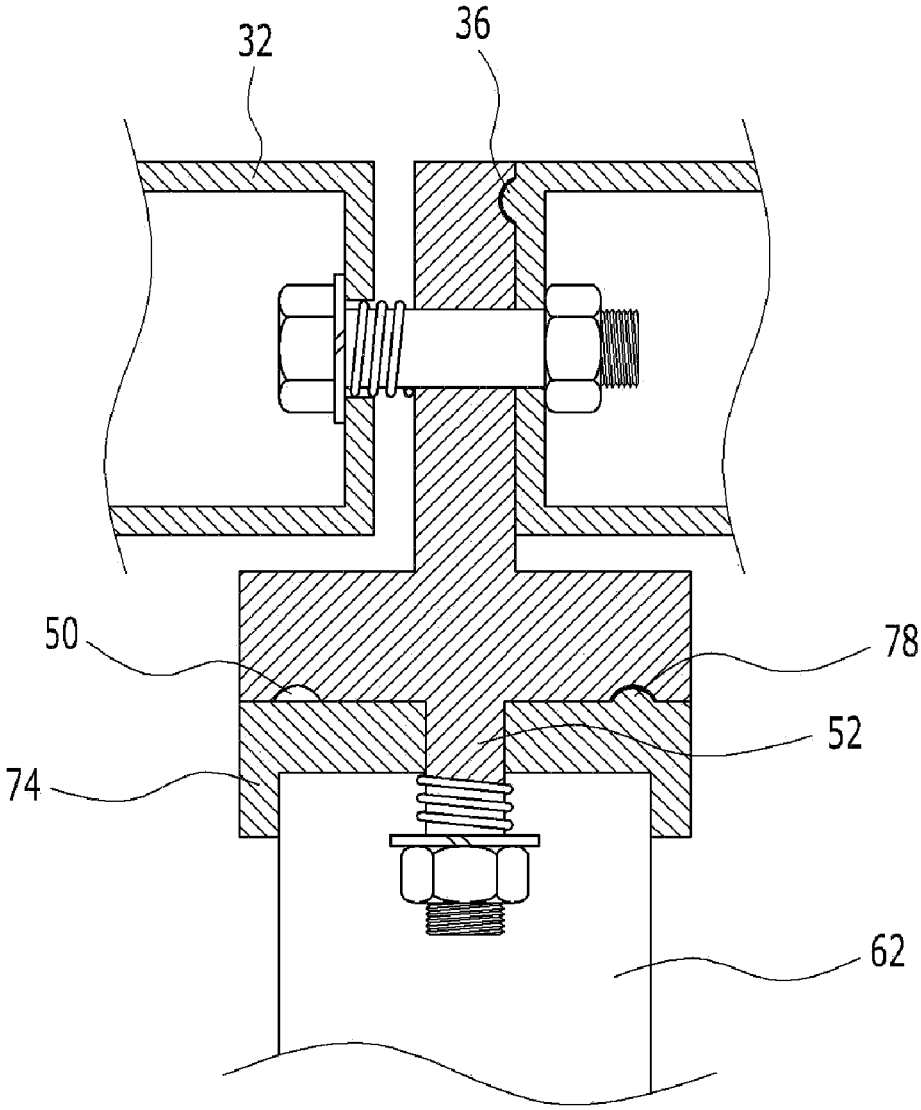
FIG. 5 is an enlarged sectional view of part A in FIG. 1.
Figure 6:
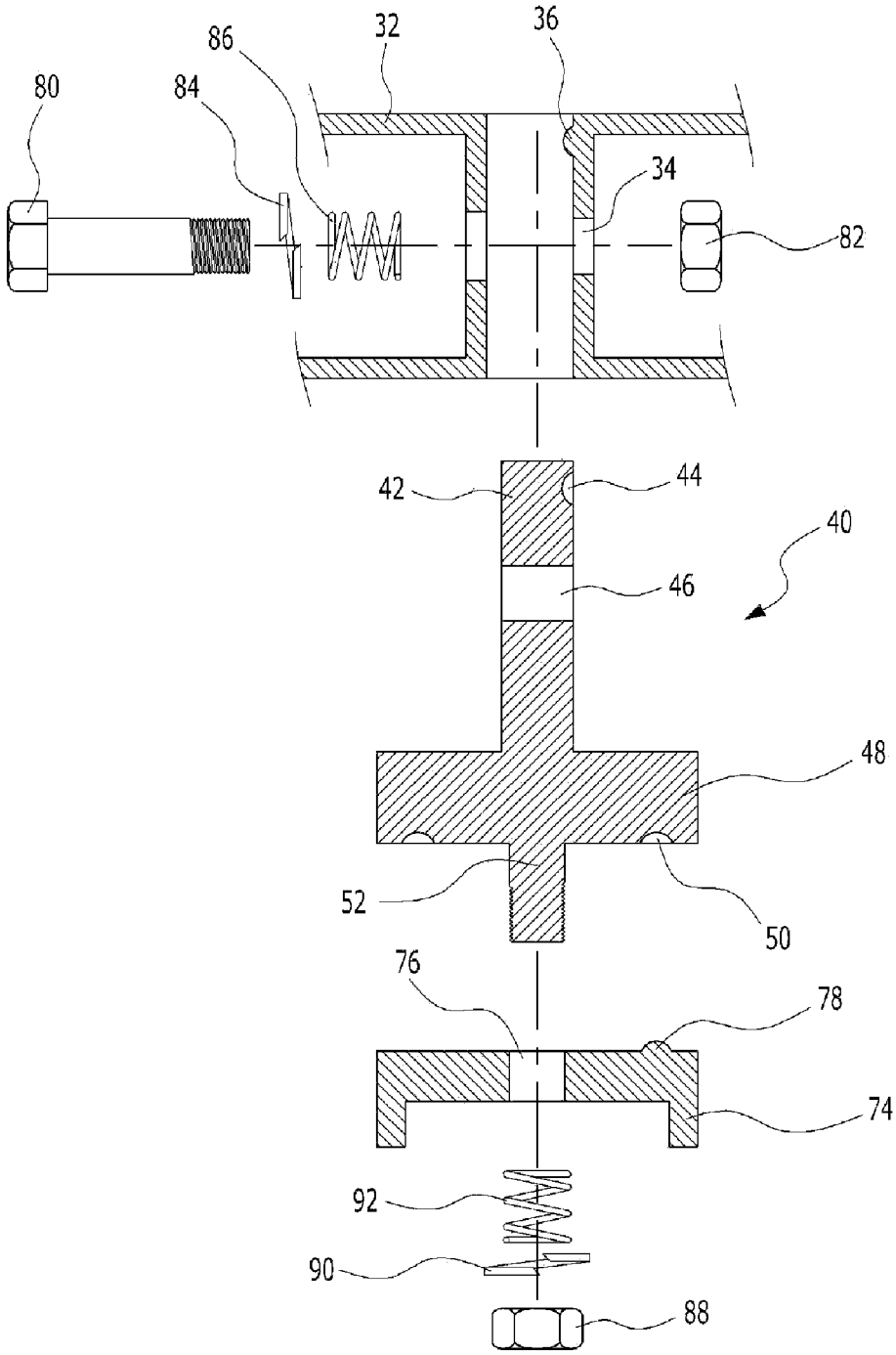
FIG. 6 is an exploded view of FIG. 5, illustrating various disassembled components thereof.
Figure 7:
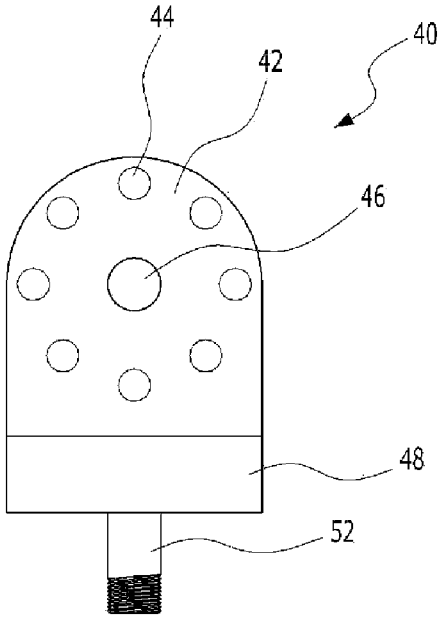
FIG. 7 is a side view of a hinge of the illumination apparatus of FIG. 1, according to one exemplary embodiment of the present disclosure.
Figure 8:
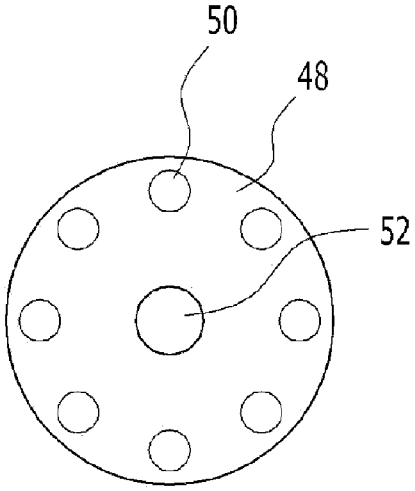
FIG. 8 is a plan view of the lower portion of the hinge shown in FIG. 7 when viewed from the bottom thereof.

FIG. 5 is an enlarged sectional view of part A shown in FIG. 1; FIG. 6 is an exploded view of FIG. 5, illustrating various exemplary components thereon; FIG. 7 is a side view of a hinge according to one exemplary embodiment; FIG. 8 is a plan view of the hinge shown in FIG. 7 when viewed from the bottom thereof.

As shown in FIGS. 5 and 6, the engaging members 32 of the cap 30 is linked to the first coupler 74 through the hinge 40. The engaging member 32 comprises a first through-hole 34 formed on a side surface that faces an adjacent engaging member 32 and a first protrusion 36 formed near the first through-hole 34 on one side surface of the engaging member 32. The first coupler 74, which combines the light module 62 and the heat dissipation plate 72, comprises a third-through hole 76 formed at the center location that corresponds to the location of a rotational shaft 52 formed at the bottom of a second part 48 of the hinge 40. At its peripheral region, the first coupler 74 may also comprise a second protrusion 78 projecting from the top surface that faces the hinge 40.

The hinge 40 may comprise a first part 42 and a second part 48. As best shown in FIG. 7, the first part 42 may comprise a semi-circular plate member projecting perpendicularly from the second part 48 across the diameter of the second part 48. The first part 42 has a second through-hole 46 formed at a center location corresponding to the first through-hole 34 of the engaging member 32. The first part 42 may also comprise a plurality of first depressions 44 configured to accommodate the first protrusion 36 of the engaging member 32. The first depressions 44 are radially disposed in the peripheral region of the first part 42 around the second through-hole 46 with an equal interval.

As shown in FIG. 5, when the first part 42 of the hinge 40 engages with the engaging member 32 of the cap 30, the first surface of the first part 42 that has the first depressions 44 contacts the surface of the engaging member 32 that has the first protrusion 36, while the second surface opposite to the first surface of the first part 42 (i.e., the surface without the first depressions 44) is spaced apart from the surface of the engaging member 32 that has no first protrusion 36. To engage the first part 42 to the engaging member 32, the first through-hole 34 of the engaging member 32 and the second through-hole 46 of the first part 42 are first aligned, and a bolt 80 is passed through the first and second through-holes 34, 46 to engages a nut 82. Any other fastening device known in the art may be used alternatively or additionally.

A first spring 86 may be inserted in the first through-hole 34 while wrapping a body of the bolt 80. Here, the first spring 86 may be positioned between the head of the bolt 80 and the second surface of the first part 42. The first spring 86 applies a spring force to the hinge 40 such that the first surface of the first part 42 having the first depressions 44 contacts the surface of the engaging member 32 that has the first protrusion 36. The hinge 40 may be fixed by lodging the first protrusion 36 into one of the first depressions 44 in the first part 42. A first twisted washer 84 may be inserted between the bolt 80 and the first spring 86, as best shown in FIG. 6.

Using the bolt 80, which connects the first part 42 of the hinge 40 and the engaging member 32 of the cap 30, as a rotational axis, the light module 62 may rotate 180 degrees in the first direction with its unconnected distal end making a circular arc around the bolt 80. When a force sufficient to compress the first spring 86 (e.g., force sufficient to overcome the spring force of the first spring 86) is exerted to the light module 62, the first part 42 of the hinge 40 may be separated from the surface of the engaging member 32 that has the first protrusion 36.

Figure 3:
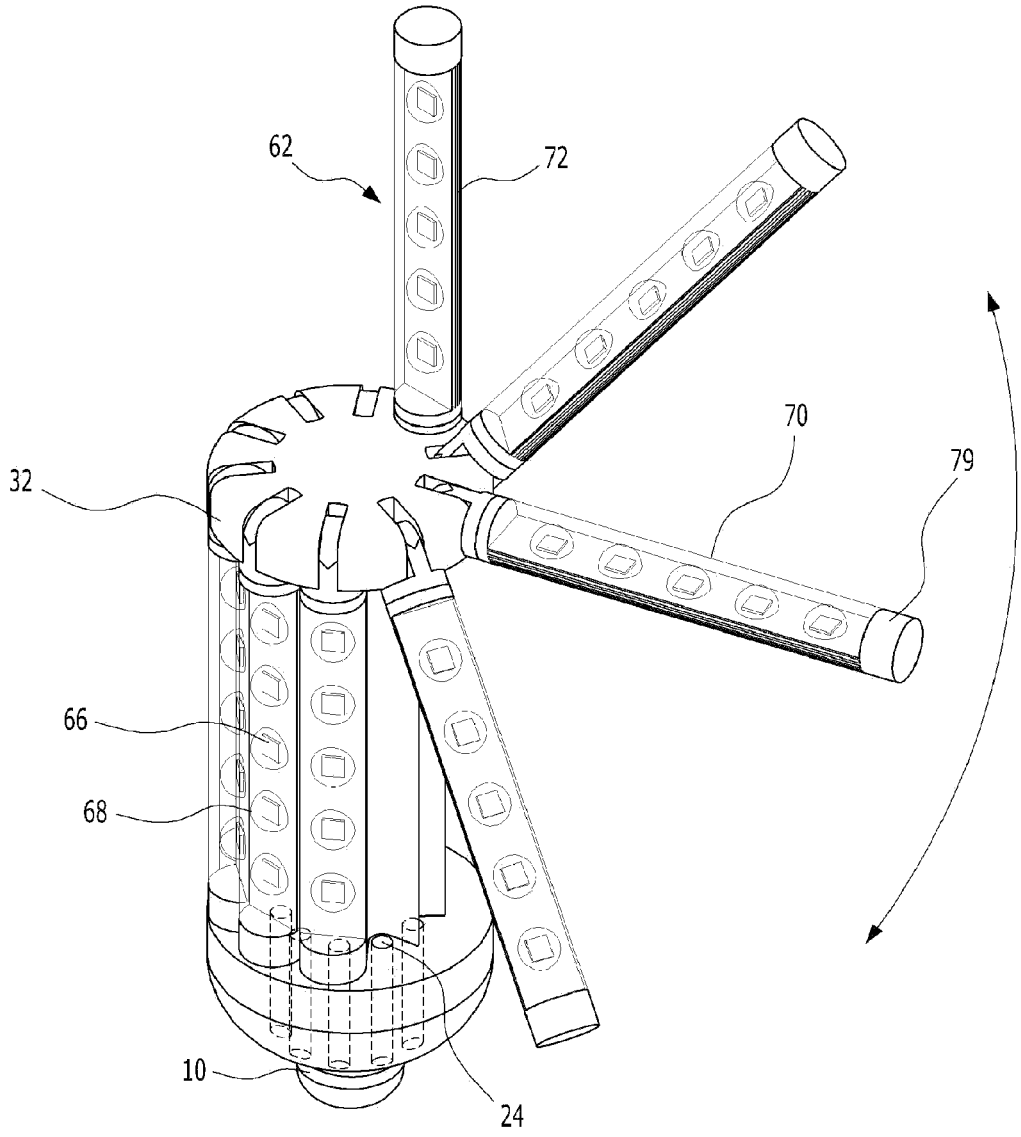
FIG. 3 is a perspective view of the illumination apparatus of FIG. 1, illustrating a plurality of light modules, constituting the light sources, rotating with respect to a cap while its one end is linked to an engaging member of the cap.
Figure 4:
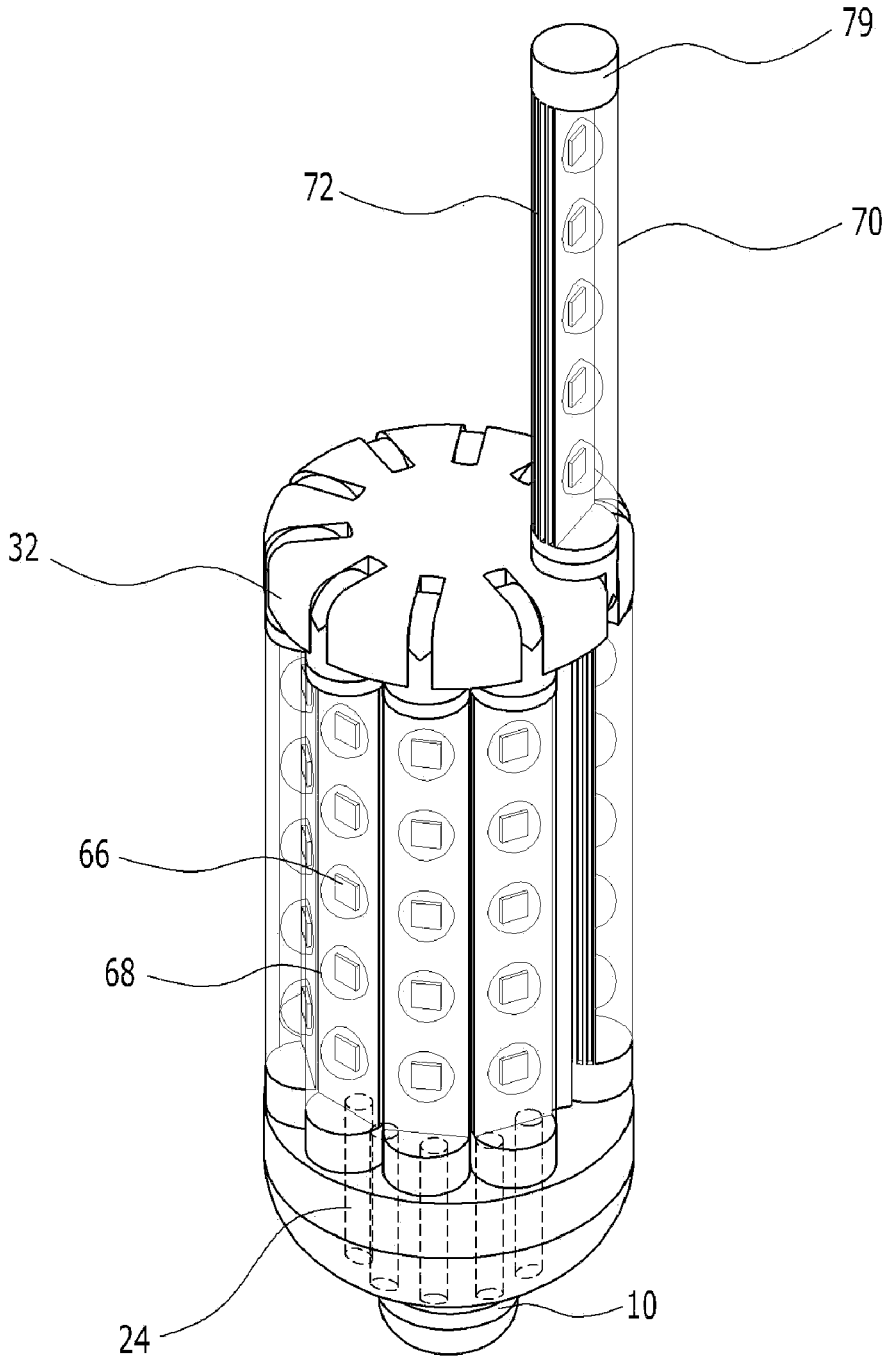
FIG. 4 shows a perspective view of the illumination apparatus of FIG. 1, illustrating a condition at which one of the light modules is rotated to an axial position.

At this time, the first protrusion 36 of the engaging member 32 can be dislodged from the first depression 44 formed on the first part 42 of the hinge 40. The light module 62 may then freely rotate in the first direction, as shown in FIGS. 2 and 3. The rotational angle of the light module 62 with respect to the engaging member 32 may be controlled by selectively lodging the first protrusion 36 of the engaging member 32 into one of the depressions 44 formed on the first part 42 of the hinge 40.

It should be understood that the use of the first protrusion 36 and the first depressions 44 to control the rotational angle of the light module 62 is merely an example of many possible alternatives. For example, in some exemplary embodiments, the first part 42 of the hinge 40 and the engaging member 32 may have corresponding continuous (or discontinuous)

indented patterns (e.g., grooves, ribs, etc.) formed around their peripheral regions to enable minute adjustment of the rotational angle.

As shown in FIG. 8, the second part 48 of the hinge 40 may comprise a round plate and an axial shaft 56 projecting from the center of the bottom surface of the round plate. The second part 48 may have a plurality of second depressions 50 radially disposed with an equal interval at its peripheral region.

As shown in FIGS. 5 and 6, the second part 48 can be attached to the first coupler 74 by passing the axial shaft 56 through the third through-hole 76 and engaging with a nut 88. A second spring 92 may be positioned between the nut 88 and the first coupler 74. With this structure, the second spring 92 applies a spring force to the first coupler 74 such that the surface of the first engaging member 74 that has the second protrusion 78 contacts the bottom surface of the second part 48 of the hinge 40 that has the second depressions 50. The light module 62 and the heat dissipation plate 72 are fixed by lodging the second protrusion 78 of the first coupler 74 into one of the second depressions 50 in the second part 48. A second twisted washer 90 may be inserted between the nut 88 and the second spring 92.

With the above engagement between the second part 48 and the coupler 74, the light module 62 may freely rotate 360 degrees with respect to the axial shaft 52 of the second part 48. The second part 48 of the hinge 40 may be separated apart from the first coupler 74 by exerting a force sufficient to compress the second spring 92 to the light module 62.

At this time, the second protrusion 78 formed on the first coupler 74 can be dislodged from the second depression 50 formed on the bottom surface of the second part 48. The light module 62 may then freely rotate 360 degrees in the second direction with respect to the axial shaft 52, as shown in, for example, FIG. 4.

It should be understood that the use of the second protrusion 78 and the second depressions 50 to control the rotational angle of the light module 62 is merely an example of many possible alternatives. For example, in certain exemplary embodiments, the second part 48 of the hinge 40 and the first coupler 74 may have corresponding continuous (or discontinuous) indented patterns (e.g., grooves, ribs, etc.) formed around their peripheral regions to enable minute adjustment of the rotational angle.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An illumination apparatus comprising:

a socket;

a cylindrical body having one end connected to the socket, the cylindrical body comprising an inner space for receiving a driving circuit and a wire;

a cap connected to the other end of the cylindrical body, the cap comprising a plurality of engaging members disposed around a circumference of the cap with an equal interval;

a hinge portion comprising a plurality of hinges for rotationally connecting the plurality of engaging members;

a light source portion comprising a plurality of light modules, each of the plurality of light modules comprising a plurality of light emitting devices arranged therein, each of the plurality of light modules being configured to rotate with the hinge portion in a first direction with respect to a respective one of the plurality of engaging members via the hinge; and a heat dissipater having a plurality of heat dissipation plates, each of the heat dissipation plates being in contact with a bottom portion of the respective light module.

2. The illumination apparatus according to claim 1, further comprising an elongated receiving groove formed along a lengthwise direction on a surface of a middle portion of the body, the receiving grooving comprising a semi-circular shape.

3. The illumination apparatus according to claim 2, further comprising:

an intake passageway located at a portion of the body that connects to the cap, the intake passageway being configured to spatially connect the receiving groove to the outside of the body; and an exhaust passageway at a portion of the body that connects to the socket, the exhaust passageway being configured to spatially connect the receiving groove to the outside of the body.

4. The illumination apparatus according to claim 1, wherein the plurality of engaging members comprise first through-holes on side surfaces that face one another and a first protrusion formed on one of the side surfaces near the first through-hole.

5. The illumination apparatus according to claim 4, wherein each of the hinges further comprises:

a first part comprising a semi-circular plate member having a second through-hole formed at a center location corresponding to the first through-hole, the plate member further comprising a plurality of first depressions configured to receive the first protrusion, the plurality of first depressions being radially disposed with an equal interval around a peripheral region of a surface that contacts the engaging member; and a second part comprising a diameter forming a perpendicular angle with respect to the first part, the second part comprising an axial shaft disposed at a center of a bottom surface thereof and a plurality of second depressions disposed radially around a peripheral region with an equal interval.

6. The illumination apparatus according to claim 5, wherein the first part of the hinge and the engaging member are engaged through a bolt and a nut that pass through the first and second through-holes.

7. The illumination apparatus according to claim 6, further comprising a spring having a spring force inserted in the first through hole while wrapping a body of the bolt between a head of the bolt and the first part.

8. The illumination apparatus according to claim 5, wherein the second part of the hinge engages the axial shaft with a nut when the axial shaft passes through a third through-hole formed at a center of a first coupler.

9. The illumination apparatus according to claim 8, further comprising a second spring positioned between the first coupler and the nut.

10. The illumination apparatus according to claim 1, wherein the plurality of light emitting devices comprise LEDs or OLEDs.

11. The illumination apparatus according to claim 10, wherein the plurality of light emitting devices are selected from a group of red (R), green (G), blue (B), and white (W) light emitting devices.

12. The illumination apparatus according to claim 10, wherein the plurality of light emitting devices comprises red (R), green (G), blue (B), or white (W) light emitting devices mounted on a single printed circuit board.

13. The illumination apparatus according to claim 10, wherein the plurality of light emitting devices are sealed by lenses formed of transparent or translucent synthetic resin in a hemispheric shape.

14. The illumination apparatus according to claim 13, wherein the lenses have their radii of curvature decreasing from a first end of the light module that connects to the hinge to a second end opposite to the first end.

15. The illumination apparatus according to claim 10, wherein the plurality of light modules further comprise semi-cylindrical covers for sealing the light modules.

16. The illumination apparatus according to claim 10, wherein the plurality of light modules further comprise semi-cylindrical cover for sealing the light modules, each of the covers comprising a plurality of protruding lenses at a location where the corresponding light emitting devices are located.

17. The illumination apparatus according to claim 1, wherein each of the light modules is configured to axially rotate in a second direction with respect to the hinge portion.

18. The illumination apparatus according to claim 17, wherein the light module is configured to rotate 180 degrees in the first direction while one end of the light module is connected to the hinge and rotate 360 degrees in a second direction with respect to a longitudinal direction of the light module.

* * * * *